US005650236A

United States Patent [19]

Hirano et al.

[11] Patent Number: 5,650,236

[45] Date of Patent: Jul. 22, 1997

[54] MAGNETIC MARKER

[75] Inventors: Toshiyuki Hirano; Katsuhiro Kawashima, both of Uji; Isamu Ogasawara, Otsu, all of Japan

[73] Assignee: Unitika Ltd., Hyogo, Japan

[21] Appl. No.: 551,610

[22] Filed: Nov. 1, 1995

[30] Foreign Application Priority Data

Nov. 2, 1994 [JP] Japan ..... 6-269481
Oct. 13, 1995 [JP] Japan ..... 7-265282

[51] Int. Cl.[6] ..... G08B 13/24

[52] U.S. Cl. ..... 428/611; 428/900; 428/928; 340/551; 340/572

[58] Field of Search ..... 428/611, 614, 428/626, 928, 900; 340/551, 572

[56] References Cited

U.S. PATENT DOCUMENTS 4,652,863 3/1987 Hultman ..... 340/551
5,130,698 7/1992 Rauscher ..... 340/551
5,181,020 1/1993 Furukawa et al. ..... 428/900
5,181,021 1/1993 Kelly et al. ..... 340/572
5,519,379 5/1996 Ho et al. ..... 340/551
5,538,803 7/1996 Gambino et al. ..... 340/551

FOREIGN PATENT DOCUMENTS 516244 12/1992 European Pat. Off. .
4-195384 7/1992 Japan .

OTHER PUBLICATIONS

Patent Abstracts of Japan, vol. 16, No. 525 (P–1446), 28 Oct. 1992.
Patent Abstracts of Japan, vol. 11, No. 117 (E–498), 11 Apr. 1987.

*Primary Examiner*—John Zimmerman
*Attorney, Agent, or Firm*—Wenderoth, Lind & Ponack

[57] ABSTRACT

A magnetic marker of the present invention includes a magnetic thin wire for generating pulses and bodies of soft magnetic materials that are arranged close to the two ends of the thin wire that have a smaller coercive force than the magnetic thin wire. The magnetic thin wire has a diameter of 60–115 μm and has a ratio of $B_r/B_s$ of a B-H loop of 0.8 or more. Thus, a small magnetic marker can be formed which provides a large Barkhausen effect even if it contains a very short magnetic thin wire.

13 Claims, 4 Drawing Sheets

MAGNETIC MARKER

BACKGROUND OF THE INVENTION

1. Field of the Invention

The present invention relates to a magnetic marker attached to a good for detecting the existence of the magnetic marker.

2. Description of the Prior Art

It is known to attach markers to goods to detect a quantity and kind of goods or to prevent theft. Such markers are attached to a good so that the marker cannot be noticed readily, and they are detected by using magnetic properties or microwaves.

There are various kinds of such markers. For example, if an amorphous thin ribbon or thin wire marker is subjected to an AC magnetic field, disturbances in the magnetic field of a scan area or harmonic components of an output pulse from the magnetic field can be detected. Another example of a marker is one which comprises a coil and a capacitor made of aluminum which is subjected to radiation or electric waves, thus enabling LC resonance detection. Among the markers, there is a magnetic marker having large Barkhausen characteristic, and sharp pulses generated on magnetization reversal can be detected from an AC magnetic field. This marker has the advantages of having a high sensitivity, a light weight and less erroneous detections.

Large Barkhausen reversal is a phenomenon caused by the movement of magnetic domains in a material, and it occurs when a limit magnetic filed H* needed to generate inverse magnetic domains is larger than a minimum magnetic filed $H_O$ needed to move magnetic domains. Inverse magnetic domains are formed when an effective magnetic field $H_{eff}$, which is equal to an external magnetic field $H_{ex}$ substrated by a demagnetizing field $H_d$ generated at the magnetic thin wire by the external magnetic filed $H_{ex}$, exceeds the limit magnetic field H*. The inverse magnetic domains, upon formation, instantly move to generate a sharp magnetization reversal. It is characteristic of a large Barkhausen reversal that an output induced voltage accompanied by the magnetization inversion is constant irrespective of either the external magnetic field or a speed of change in magnetic field, and that a sharp pulse waveform having high harmonic components is present.

Among such magnetic markers, a marker disclosed in Japanese Patent laid open Publication 4-195384/1992 has a structure in which soft magnetic materials having a low coercive force are arranged at two ends of a magnetic thin wire for generating pulses. The magnetic thin wire displays a large Barkhausen effect, and the two soft magnetic materials have a coercive force $H_c$ that is smaller than that of the magnetic thin wire. The demagnetizing field of the magnetic thin wire for generating pulses is reduced by arranging the soft magnetic materials as being close to the magnetic bar. As a result, the magnetic marker can be made compact.

Because the magnetic thin wire of the magnetic marker has a diameter of 120 μm, if the length of the magnetic thin wire is as short as 50 mm or less, a good large Barkhausen effect cannot be generated, and a practically large output voltage cannot be obtained. However, it is desirable to have a magnetic marker with a shorter length to make it more compact.

SUMMARY OF THE INVENTION

An object of the present invention is to provide a small magnetic marker which shows a large Barkhausen reversal.

A magnetic marker according to the present invention for generating a large Barkhausen effect comprises a magnetic thin wire for generating pulse signals, and two magnetic plates having a coercive force smaller than that of the magnetic thin wire. The magnetic thin wire has a diameter of 60–115 μm and has a rectangular ratio $B_r/B_s$, of the B-H loop of 0.8 or more. The magnetic marker generates a large Barkhausen effect in a magnetic field to generate pulses induced in a coil for detection.

A feature of the present invention is that the magnetic marker comprises a combination of the magnetic thin wire for generating pulse signals and the magnetic materials for reducing a demagnetizing field. The magnetic materials have a coercive force that is smaller than that of the magnetic thin wire and are arranged closely at the two ends of the magnetic thin wire, so that they reduce the demagnetizing field of the magnetic thin wire. Therefore, even if only the magnetic thin wire used as a marker is short and a large Barkhausen reversal is not observed because of the presence of a large demagnetizing field, the magnetic marker including the same magnetic thin wire in combination with the magnetic materials can induce pulses in a coil so as to generate an excellent induced voltage by a large Barkhausen effect.

The magnetic thin wire for generating pulses has a diameter in a range of 60 to 115 μm and has 0.8 or more of a rectangular ratio $B_r/B_s$ of a B-H loop or a magnetization curve, where $B_r$ denotes a remanent magnetic flux under zero external magnetic filed and $B_s$ denotes a saturation magnetic flux when magnetization saturates. If the rectangular ratio $B_r/B_s$ of the magnetic thin wire is 0.8 or more, high pulse electric voltages suitable for a marker can be generated. If the diameter (cross section) of the magnetic thin wire becomes smaller, the demagnetizing field of the magnetic thin wire can be reduced, and the length of the magnetic thin wire can be shortened in accordance with the reduction of the cross section of the magnetic thin wire. The present invention makes it possible to provide a compact magnetic marker without deteriorating an excellent induced voltage by a large Barkhausen effect (pulse voltage values and harmonic components).

When the rectangular ratio $B_r/B_s$ of the magnetic thin wire is 0.8 or more, the demagnetizing field becomes large when the diameter of the wire is larger than 115 μm, of the total magnetic flux becomes small when the diameter is smaller than 60 μm. Accordingly, an excellent induced voltage by a large Barkhausen effect cannot be generated. Even if the rectangular ratio $B_r/B_s$ of the magnetic thin wire is smaller than 0.8, a large Barkhausen reversal does not occur when the diameter of the wire is large, whereas the total magnetic flux becomes small when the diameter is small and a large Barkhausen reversal occurs. Then, an excellent induced voltage by a large Barkhausen effect for a magnetic marker cannot be generated. The length of the magnetic thin wire is preferably 10–100 mm, or more preferably 15–50 mm.

The two magnetic materials of the present invention are required to have a coercive force smaller than that of the magnetic thin wire, and it is preferable to use a magnetic sheet (magnetic thin plate) having a coercive force smaller than that of the magnetic thin wire. The coercive force of the magnetic thin wire is based on a value measured for a sample having a length of 100 times the diameter of the wire or longer, and the coercive force of the magnetic materials is based on a value measured for a sample having a length larger than 100 times the thickness of the magnetic material or longer.

The magnetic sheet of the present invention refers to a sheet having a thickness of 0.01–100 μm and an area of 1–10,000 $mm^2$. If the magnetic sheet has a length of 100 times its thickness or longer, various shapes such as a circle, ellipse or polygon may be adopted for the magnetic sheets as long as the coercive force of the magnetic sheet is smaller than that of the magnetic thin wire. A rectangular magnetic sheet is most preferable so as to provide the greatest reduction of the demagnetizing field of the magnetic bar.

As to the relative position of the magnetic thin wire and the magnetic sheets, the demagnetizing field of the magnetic thin wire is reduced the greatest if the ends of the magnetic thin wire are located at the center of the magnetic sheets.

An advantage of the present invention is to provide a very small magnetic marker having a high output voltage and large harmonic components resulting from a large Barkhausen effect.

BRIEF DESCRIPTION OF THE DRAWINGS

These and other objects and features of the present invention will become clear from the following description taken in conjunction with the preferred embodiments and with reference to the accompanying drawings, in which.

DETAILED DESCRIPTION OF THE PREFERRED EMBODIMENTS

Figure 1:
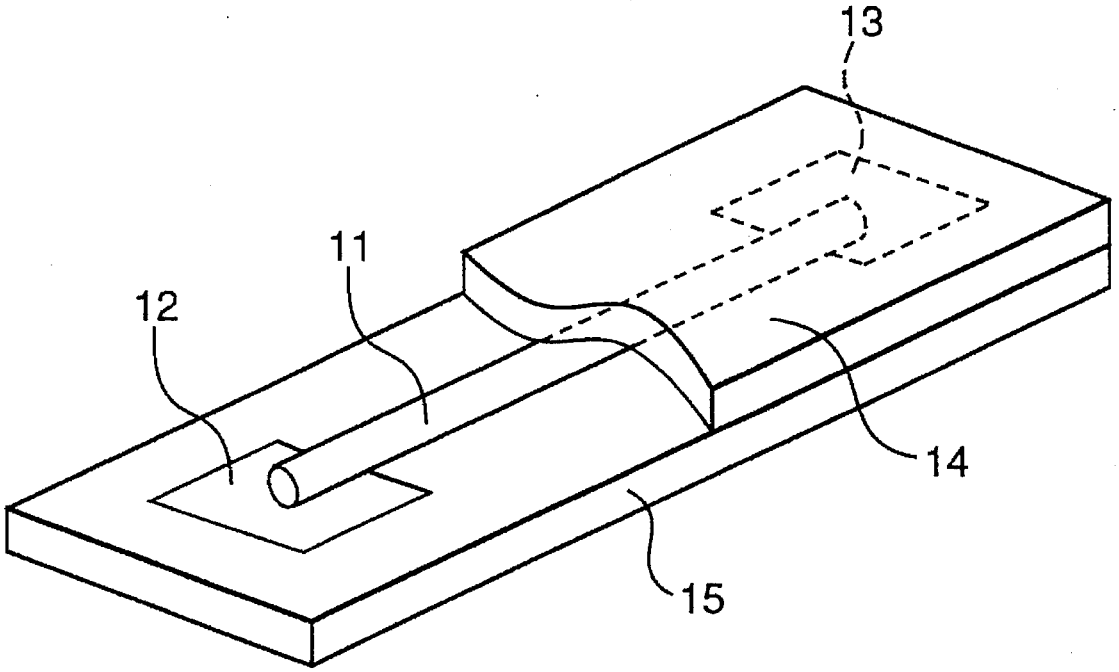
FIG. 1 is a partially exposed perspective view of a magnetic marker of the first to sixth examples of the present invention.

Referring now to the drawings, wherein like reference characters designate lie or corresponding parts throughout the several views, embodiments of the present invention will be explained with reference to the appended drawings according to examples.

In general, in order to produce a compact magnetic thin wire, it is necessary to shorten the length of a magnetic thin wire for generating pulses. However, if a ratio (aspect ratio) of a length to a diameter of the magnetic thin wire is reduced, the demagnetizing field of the magnetic thin wire increases, and an excellent induced voltage by a large Barkhausen effect cannot be generated by using a coil for detection. Further, an output electric voltage induced in the coil depends on the total charge of magnetic flux, and if the length and the diameter of the magnetic thin wire are decreased under the same aspect ratio, a signal-to-noise ratio of the magnetic marker decreases, and thus a good magnetic marker cannot be provided.

In order to produce a magnetic marker of high performance, it is required to reduce the size of the magnetic thin wire to decrease the demagnetizing field while increasing the total magnetic flux subjected to the magnetic reversal. It is necessary for the magnetic thin wire of the present invention for generating pulses to have a diameter of 60–115 μm and 0.8 or more of a rectangular ratio $B_r/B_s$ of a B-H loop.

An amorphous magnetic thin wire having magnetostriction of an absolute value of $1*10^{-6}$ or more is preferable for a magnetic thin wire that has a small diameter and 0.8 or more of a rectangular ratio $B_r/B_s$. The magnetic thin wire is fabricated by a cold wire drawing process according to a conventional drawing process of a metallic thin wire and is then subjected to a thermal treatment after the drawing process. The drawing of the magnetic thin wire can be performed with a reduction ratio of cross section of 5–15% with a die, and the drawing up to a desired diameter can be attained by using a plurality of dies. The thermal treatment for the magnetic thin wire having a diameter in the above-mentioned range can be performed under tensile strengths of 10–250 $kg/mm^2$ at temperatures of 300°–500° C. for a period in a range of 0.1 to 1000 seconds, to result in a magnetic thin wire having desired magnetic characteristics. The following explanation relates to examples or embodiments using rectangular magnetic sheets (magnetic thin plates) in magnetic markers having the magnetic thin wire displaying a large Barkhausen effect and arranging the magnetic sheets (magnetic thin plates) close to the magnetic bar. However, the invention can also be applied to combinations of the magnetic thin wire with various shapes of the magnetic sheets.

First, magnetic markers of first to sixth examples of the invention are explained. FIG. 1 shows a schematic view of the magnetic marker of the examples. The magnetic marker comprises a magnetic thin wire 11 as an element for generating pulses and two rectangular magnetic sheets 12 and 13 arranged close to the two ends of the magnetic thin wire 11, and they are fixably interposed between base materials 14 and 15. The material and the thickness of the base materials 14 and 15 are variable according to particular applications of the magnetic marker usually, the base materials 14, 15 are polyethylene terephthalate (PET) film adhesion sheets having a thickness of about 30 μm. The base material 15 has an adhesion layer (not shown) at the bottom for attaching the magnetic marker to a good that is to be detected. On the other hand, an adhesion layer (now shown) at the top of the base material 15 is provided for fixing the magnetic thin wire 11 and the magnetic sheets 12 and 13 onto the base material and for adhering the other base material 14 to them. In the arrangement of the magnetic thin wire 11 and the magnetic sheets 12 and 13, the two ends of the magnetic thin wire 11 are preferably located at positions (centers) having equal distances from each side of the magnetic sheets 12 and 13, as shown in FIG. 1. For example, the magnetic sheets 12 and 13 have a square shape with a side of 10 mm, and a thickness of 20 μm.

First to sixth examples with a shape shown in FIG. 1 having various diameters and rectangular ratios $B_r/B_s$ are produced, and first to fifth comparison examples are produced similarly, as compiled in Table 1.

Figure 2:
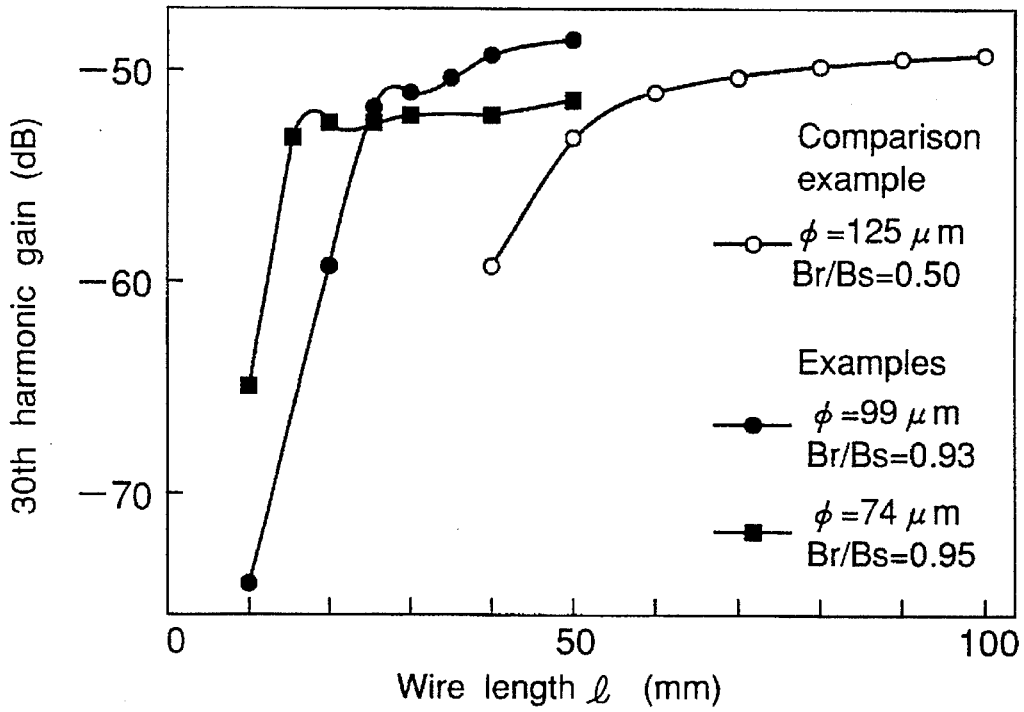
FIG. 2 is a graph of a gain of the 30th harmonic wave plotted against the length of the magnetic thin wire for various examples.

FIG. 2 shows a relation of the length of the amorphous magnetic thin wire 11 to harmonic components of output pulses in the magnetic marker shown in FIG. 1. In the magnetic marker of the third example, the magnetic thin wire is a Co—Fe amorphous magnetic thin wire having a diameter of 99 μm, a rectangular ratio $B_r/B_s$ of 0.93 and a coercive force of 0.25 Oe, while in the magnetic marker of the sixth example, the magnetic thin wire is a Co—Fe amorphous magnetic thin wire having a diameter of 74 μm, a rectangular ratio $B_r/B_s$ of 0.95 and a coercive force of 0.35 Oe. On the other hand, in the magnetic marker of the first comparison example, the magnetic thin wire is a Co—Fe amorphous magnetic thin wire having a diameter of 125 μm, a rectangular ratio $B_r/B_s$ of 0.5 and a coercive force 0.12 Oe. The data of the third and sixth examples is displayed with solid circles and solid squares, while the data of the first comparison example is displayed with circles. The coercive force is measured on a thin wire having a length of 15 cm in an excitation magnetic field of 1 Oe and frequency of 50 Hz. In the two examples and the comparison example, the magnetic sheets 12 and 13 are Co-based amorphous ribbon with a square shape having a side of 10 mm and thickness of 20 μm. The coercive force of the magnetic sheets measured in an excitation magnetic field of 1 Oe at a frequency of 50 Hz is 0.03 Oe. The rectangular ratio $B_r/B_s$ is measured on an amorphous magnetic thin wire sufficiently long so as not to be affected by the demagnetizing field.

The magnetic marker is magnetized in an alternating magnetic field of amplitude of 1 Oe at a frequency of 50 Hz, and an induction voltage is detected with a coil having a length of 35 mm and a winding number of 590 turns. The induced voltage in the coil is analyzed and evaluated with a dynamic signal analyzer of Hewlett Packard type 3562A. It can be determined, by measuring a gain of the 30th harmonic component of the excitation frequency, if a marker generates an excellent induced voltage by a large Barkhausen effect. It is desirable for a magnetic marker using a large Barkhausen effect to have a gain of −53 dB or more of the 30th harmonic component for a reference signal of 1 V. The measurement data on the sixth example (solid squares) shows that the magnetic marker with the magnetic thin wire as short as 15 mm has a good harmonic gain. On the other hand, in the comparison example, good harmonic gain cannot be obtained if the length of the magnetic thin wire is not 50 mm or longer.

Figure 3:
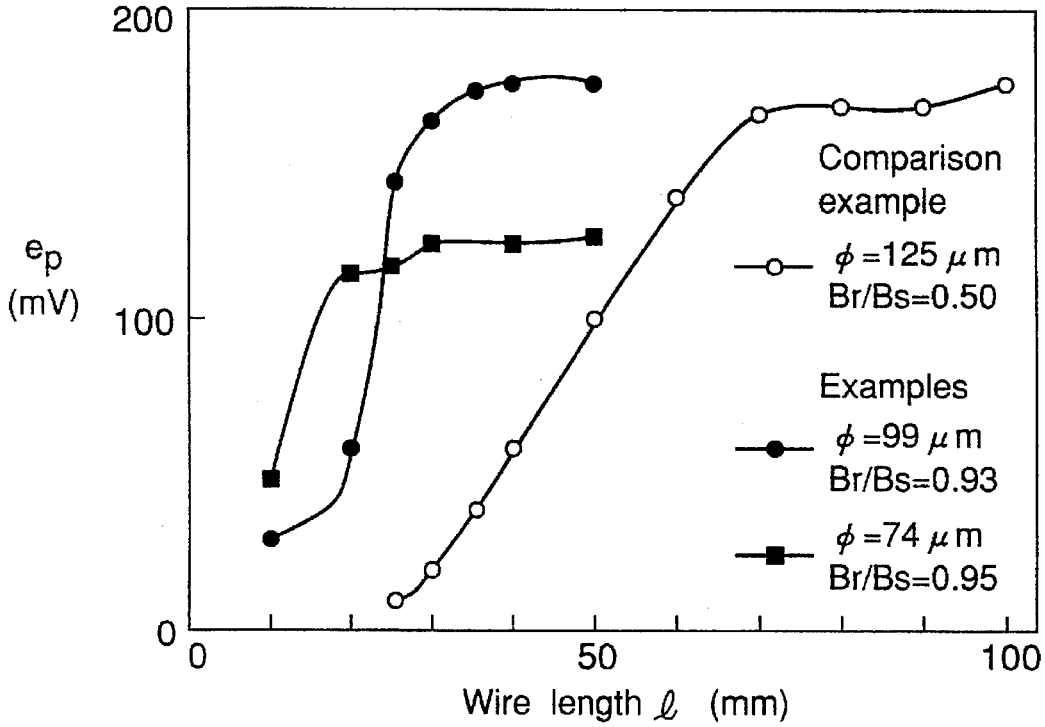
FIG. 3 is a graph of an induced voltage of the various examples plotted against the length of the magnetic thin wire.

FIG. 3 shows a characteristic of output voltage ($e_p$) induced in the coil plotted against the length of the magnetic thin wire of the magnetic markers used in the measurement shown in FIG. 2. The data for the third and sixth examples is displayed as solid circles and solid squares, while the data for the first comparison example is displayed as circles. In the magnetic markers of the sixth example (solid squares), a large Barkhausen effect of an output voltage of 100 mV or more can be generated even if the length of the magnetic thin wire 11 is as short as 15 mm. On the other hand, in the comparison example, good output voltages cannot be generated if the length of the thin wire is not 50 mm or more.

Table 1 summarizes the output voltages and 30th harmonic components of magnetic markers having a length of 25 mm and with magnetic thin wires of various diameters and various rectangular ratios $B_r/B_s$.

In Table 1, the coercive forces of each magnetic thin wire is 0.1–0.3 Oe when measured on a thin wire having a length of 10 cm in an excitation magnetic field of 1 Oe and at a frequency of 50 Hz.

TABLE 1

| | | diameter (μm) | $B_r/B_s$ | induced voltage (mV) | 30th harmonic components (dB) |
|---|---|---|---|---|---|
| Example No. | 1 | 109 | 0.82 | 113 | −50.1 |
| | 2 | 104 | 0.87 | 121 | −50.8 |
| | 3 | 99 | 0.93 | 140 | −51.0 |
| | 4 | 92 | 0.91 | 132 | −51.4 |
| | 5 | 88 | 0.88 | 134 | −52.1 |
| | 6 | 74 | 0.95 | 120 | −52.5 |
| Comparison Example No. | 1 | 125 | 0.50 | 13 | −74.3 |
| | 2 | 120 | 0.95 | 30 | −60.5 |
| | 3 | 50 | 0.95 | 60 | −57.0 |
| | 4 | 125 | 0.63 | 10 | −90.0 |
| | 5 | 70 | 0.75 | 20 | −70.0 |

As is clear from Table 1, induced voltages by a large Barkhausen effect having sufficiently large output voltages and th harmonic components can be generated for the magnetic thin wire 11 having diameters of 74–110 μm and having ratios of $B_r/B_s$ of 0.8 or more. On the other hand, as shown by the comparison examples in Table 1, if the diameter is 125 μm and the rectangular ratio $B_r/B_s$ is 0.5, a large Barkhausen reversal does not occur, and the output voltage and the 30th harmonic component are small. Even for magnetic thin wires having rectangular ratios $B_r/B_s$ of 0.9 or more, if the diameter is 120 μm, the demagnetizing field becomes large, or if the diameter is 50 μm, the total magnetic flux to be reversed is small. Therefore, excellent induced voltages by a large Barkhausen effect cannot be produced in the two cases discussed above. For magnetic thin wires with the rectangular ratio $B_r/B_s$ of less than 0.8, a large Barkhausen reversal does not occur, and good output voltages and the 30th harmonic component as a magnetic marker cannot be generated.

The advantages of the magnetic marker of the present invention are not deteriorated even if the size (area) of the two magnetic thin plates 12 and 13 which are arranged close to the magnetic thin wire is large. However, if the area of the magnetic thin plates 12 and 13 becomes large, the magnetic marker cannot be produced compactly.

Figure 4:
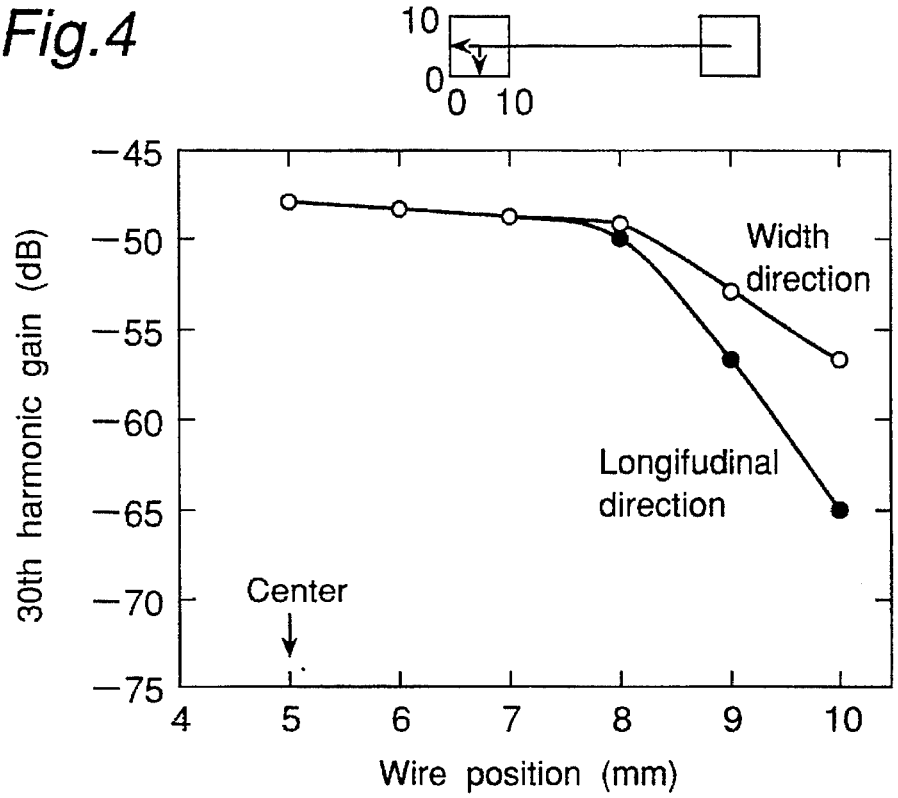
FIG. 4 is a graph of a gain of the 30th harmonic wave plotted against the position of the end of the magnetic thin wire for generating pulses.
Figure 5:
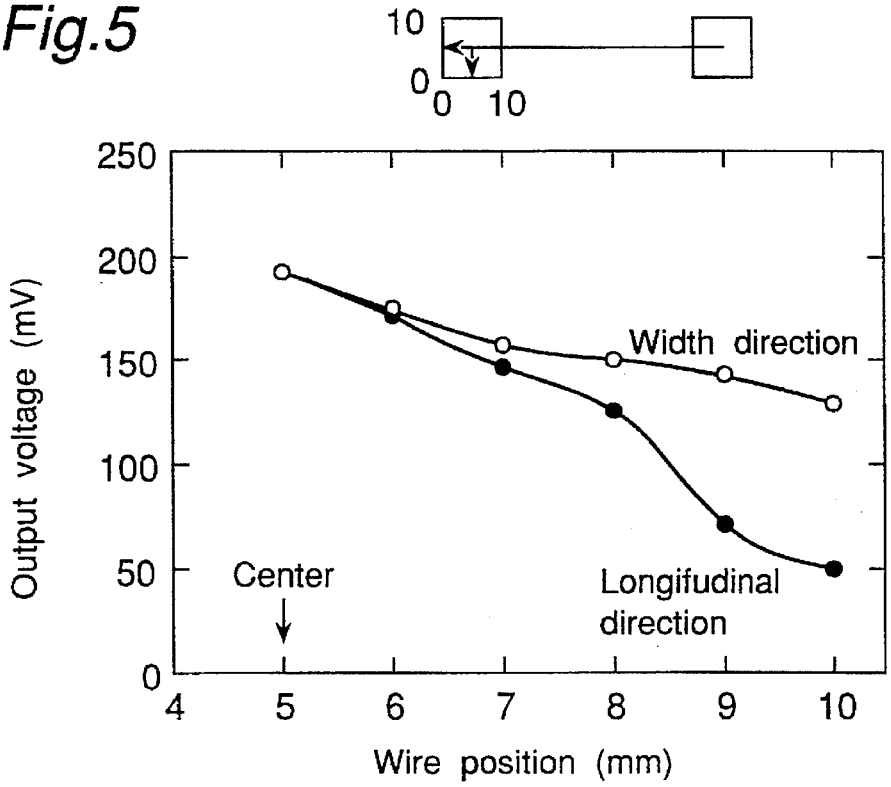
FIG. 5 is a graph of an electromagnetic induction voltage plotted against the position of the end of the magnetic thin wire for generating pulses.

Next, the relative location of the ends of the magnetic thin wire 11 in relation to the magnetic sheets 12 and 13 is explained. The magnetic thin wire 11 of the third example having a length of 25 mm is used for illustion, while magnetic sheets 12 and 13 having a thickness of 20 μm and sides of square of 10 mm are used. FIGS. 4 and 5 show the 30th harmonic gain and the output voltage respectively of the magnetic marker at various positions of the ends of the magnetic thin wire on the magnetic sheets 12 and 13. The abscissa represents the position of the end of the magnetic thin wire along longitudinal direction (solid circles or black circles) and along width direction (circles or white circles) as a distance from each side. The positions where excellent induced voltages by large Barkhausen effects are generated is described below. Along the longitudinal direction of the magnetic marker, it is desirable that the ends exist around the center of the magnetic sheet 12 and 13 within ±25% from the center as to a ratio relative to the length of the sheet along the longitudinal direction, and within ±25% from the center as to a ratio relative to the length of the sheet along the width direction.

In order to decrease the demagnetizing field of the magnetic thin wire for generating pulses, the magnetic marker of the present invention may use various shapes of the magnetic sheets other than a square as the magnetic plates are arranged close to the ends of the magnetic thin wire. Even if the shape of the magnetic sheets 12 and 13 is other than a rectangle, it is desirable that the ends of the magnetic thin wire exist within ±25% from the center of the magnetic sheet along the longitudinal direction and along the width direction.

Figure 6:
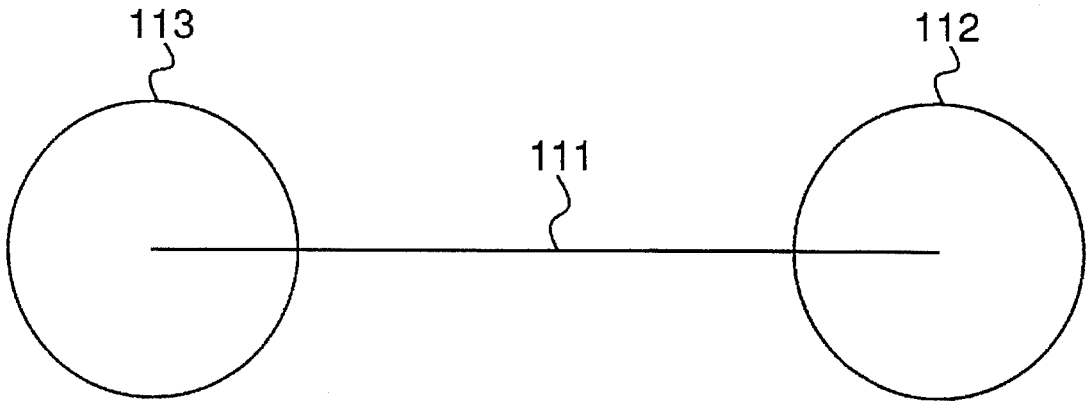
FIG. 6 is a schematic plan view of a magnetic marker of a seventh example of the present invention.

Next, a seventh example is explained. As shown in FIG. 6, circular magnetic sheets are used as the magnetic plates. The magnetic marker comprises a magnetic thin wire 111 as an element for generating pulses and two circular magnetic sheets 112 and 113 arranged close to tow ends of the magnetic thin wire 111, and they are fixably interposed between the base materials (not shown) similar to the first embodiment shown in FIG. 1. Preferably, the two ends of the magnetic thin wire 111 are positioned at the centers of the circular magnetic sheets 112 and 113. The length of the magnetic thin wire 111 is 25 mm, and the diameter of the wire is 99 μm. The rectangular ratio $B_r/B_s$ is 0.93, and the coercive force is 0.25 Oe. On the other hand, the circular magnetic sheets 112 and 113 have a thickness of 20 μm, a diameter of 10 mm and a coercive force of 0.03 Oe.

The output voltage and 30th harmonic component of the magnetic marker is measured in a manner similar to the first embodiment. The output voltage is 125 mV, and the 30th harmonic component is −52 dB. Thus, an excellent induced voltage by a large Barkhausen effect can be obtained.

Figure 7:
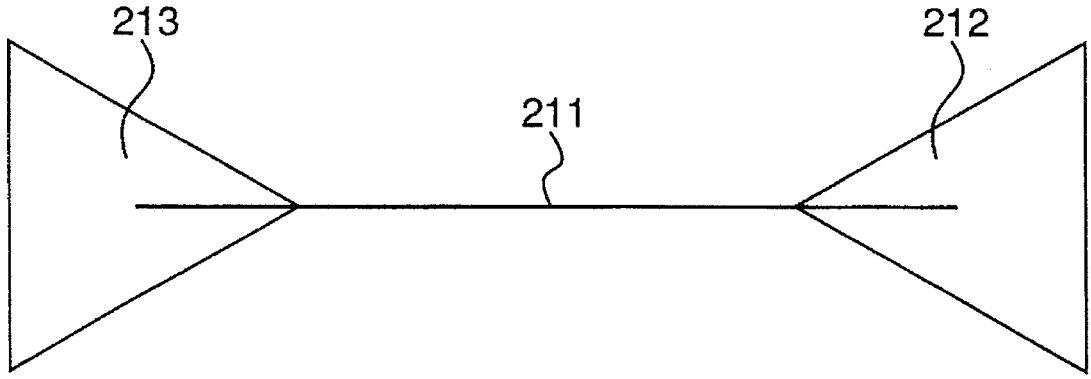
FIG. 7 is a schematic plan view of a magnetic marker of an eighth example of the present invention.

Next, an eighth example is explained. As shown in FIG. 7, triangular magnetic sheets having three equal sides are used as the magnetic plates. The magnetic marker comprises a magnetic thin wire 211 as an element for generating pulses and two triangular magnetic sheets 212 and 213 arranged close to two ends of the magnetic thin wire 211, and they are fixably interposed between the base materials (not shown) similar to the first embodiment. Preferably, the two ends of the magnetic thin wire 211 are positioned at the centers of the triangular magnetic sheets 212 and 213. The length of the magnetic thin wire 211 is 25 mm, and the diameter of the wire is 99 μm. The rectangular ratio $B_r/B_s$ is 0.93, and the coercive force is 0.25 Oe. On the other hand, the triangular magnetic sheets 212 and 213 have a thickness of 20 μm, sides of the triangle having a length of 10 mm and a coercive force of 0.03 Oe.

The output voltage and 30th harmonic component of the magnetic marker is measured in a manner similar to the first embodiment. The output voltage is 114 mV, and the 30th harmonic component is −52.4 dB. Thus, and excellent induced voltage by a large Barkhausen effect can be obtained.

Although the present invention has been fully described in connection with the preferred embodiments with reference to the accompanying drawings, it is to be noted that various changes and modifications are apparent to those skilled in the art. Such changes and modifications are to be understood as included within the scope of the present invention as defined by the appended claims.

What is claimed is:

1. A magnetic marker that displays a Barkhausen effect when subjected to a magnetic field, said magnetic marker comprising:

a magnetic thin wire that generates pulse signals when subjected to the magnetic field, wherein said magnetic thin wire has a diameter in the range of 60–115 μm and has a rectangular ratio $B_r/B_s$ of a B-H loop of 0.8 or greater; and two magnetic materials that have a coercive force which is smaller than that of said magnetic thin wire, wherein said two magnetic materials are separately located at each end of said magnetic thin wire.

2. A magnetic marker according to claim 1, wherein said magnetic thin wire is made of an amorphous magnetic material.

3. A magnetic marker according to claim 1, further comprising:

first and second base layers, wherein said magnetic thin wire and said two magnetic materials are interposed between said first and second base layers.

4. A magnetic marker according to claim 1, wherein said first and second base layers are made of a polyethylene terephthalate film.

5. A magnetic marker according to claim 1, wherein each of said two magnetic materials are magnetic sheets which have a thickness of 0.01–100 μm and an area of 1–10,000 $mm^2$.

6. A magnetic marker according to claim 3, wherein each of said two magnetic materials are magnetic sheets which have a thickness of 0.01–100 μm and an area of 1–10,000 $mm^2$.

7. A magnetic marker according to claim 1, wherein each of said two magnetic materials are made of square magnetic sheets.

8. A magnetic marker according to claim 1, wherein each of said two magnetic materials are made of circular magnetic sheets.

9. A magnetic marker according to claim 1, wherein each of said two magnetic materials are made of triangular magnetic sheets.

10. A magnetic marker according to claim 1, wherein centers of each of said two magnetic materials are located at positions within 25% from ends of said magnetic thin wire along a longitudinal direction of said magnetic marker.

11. A magnetic marker according to claim 1, wherein centers of each of said two magnetic materials are located at positions within 25% from ends of said magnetic thin wire along a width direction of said magnetic marker.

12. A magnetic marker according to claim 10, wherein centers of each of said two magnetic materials are located at positions within 25% from ends of said magnetic thin wire along a width direction of said magnetic marker.

13. A magnetic marker according to claim 12, wherein centers of each of said two magnetic materials are located at ends of said magnetic thin wire.

* * * * *